United States Patent [19]

Wright, Jr. et al.

[11] Patent Number: 4,760,977

[45] Date of Patent: Aug. 2, 1988

[54] YARN PACKAGE HOLDER

[76] Inventors: Joe Wright, Jr., P.O. Box 6763; Lang S. Ligon, P.O. Box 5578, Station B, both of Greenville, S.C. 29606

[21] Appl. No.: 113,752

[22] Filed: Oct. 28, 1987

Related U.S. Application Data

[63] Continuation-in-part of Ser. No. 931,266, Nov. 17, 1986.

[51] Int. Cl.[4] ..... B65H 49/06

[52] U.S. Cl. ..... 242/130; 242/131

[58] Field of Search ..... 242/130, 130.1, 131, 242/131.1, 129.5, 129.7, 129.71, 134, 139, 141, 46.2, 46.3, 46.6; 139/429, 450

[56] References Cited

U.S. PATENT DOCUMENTS

| | | | |
|---|---|---|---|
| 1,233,064 | 7/1917 | Kretzschmar | 242/130 |
| 1,508,105 | 9/1924 | Kamla | 242/130.1 X |
| 1,675,241 | 6/1928 | Bacon et al. | 242/130.1 |
| 1,805,495 | 5/1931 | McKean | 242/129.7 |
| 2,272,120 | 2/1942 | Javery et al. | 242/129.7 |
| 2,283,373 | 5/1942 | Krafft | 242/130.1 X |
| 2,437,888 | 3/1948 | Narki | 242/129.7 X |
| 2,546,301 | 3/1951 | Garden et al. | 242/130.1 |

FOREIGN PATENT DOCUMENTS

| | | | |
|---|---|---|---|
| 1043774 | 11/1958 | Fed. Rep. of Germany | 242/130 |
| 408762 | 4/1934 | United Kingdom | 242/130 |

*Primary Examiner*—Stanley N. Gilreath
*Attorney, Agent, or Firm*—Cort Flint

[57] ABSTRACT

A holder (18) for receiving and frictionally securing a yarn package (12) wound onto tubes of various inner diameters. The holder comprises a base support which includes an arm (20) adapted to be attached to a textile machine. Extending at a right angle from the base arm is a cantilever contact are (24) which is rigidly connected to the base. The contact arm has a contoured support arm (28) pivotally connected to its free end and extending alongside the contact arm to a point near the base support which is biased outward by a spring (34). A second embodiment (118) has two contoured support arms, one (128) of which is pivotally connected to the contact arm (124) at a point (127) intermediate a free end portion. A resilient second contoured support arm (143) is affixed to the end of the contact arm and has a portion which extends generally transverse over the longitudinal axis of the contact arm. One end (148) of the second contoured support arm extends beyond the tube contact surface of the contact arm for a slight distance and the other end (147) of the second contoured arm extends towards the base support at an acute angle to the longitudinal axis of the contact arm.

16 Claims, 4 Drawing Sheets

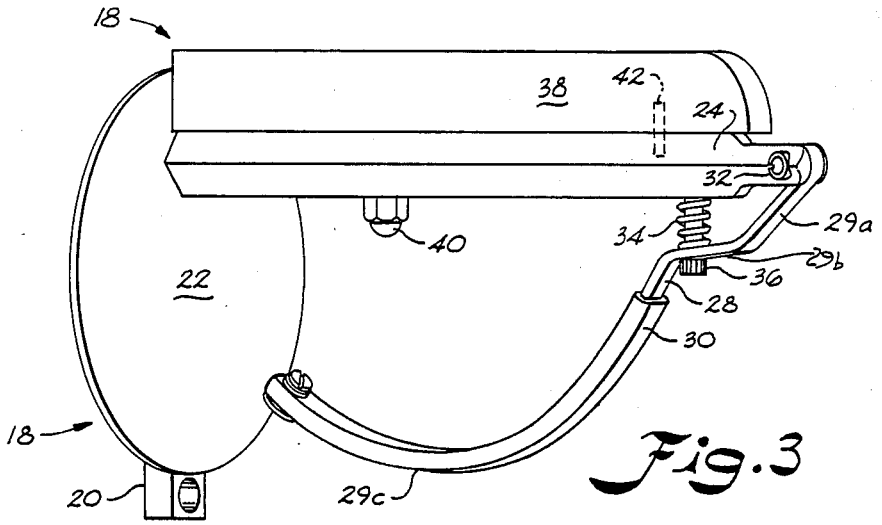
Fig. 3
Fig. 4
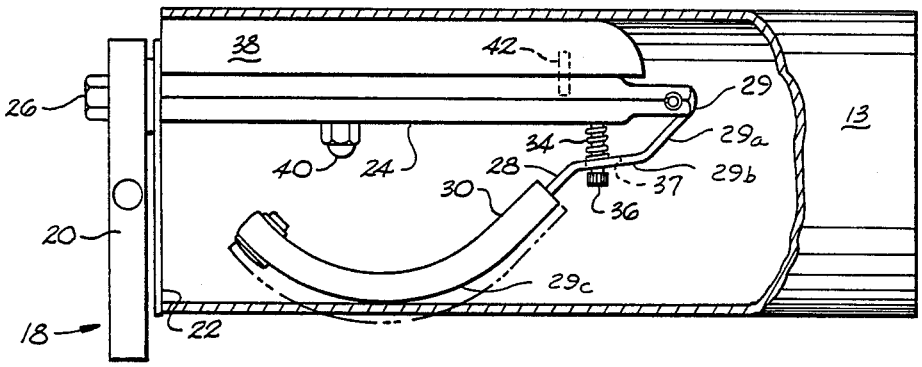
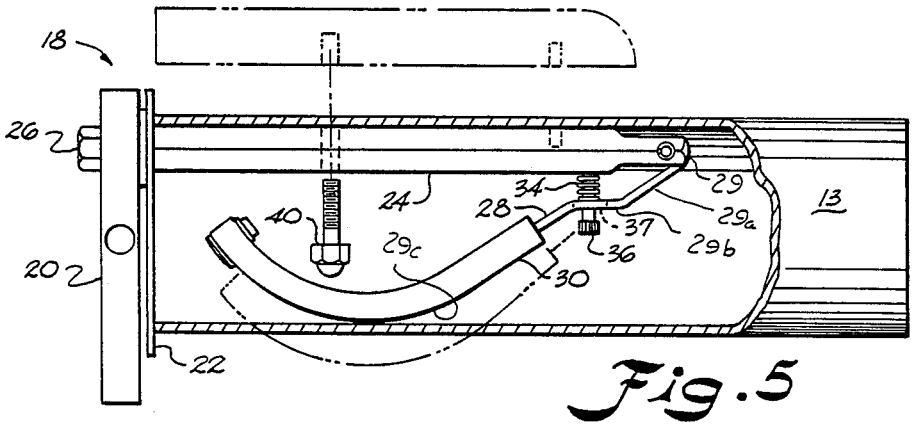
Fig. 5

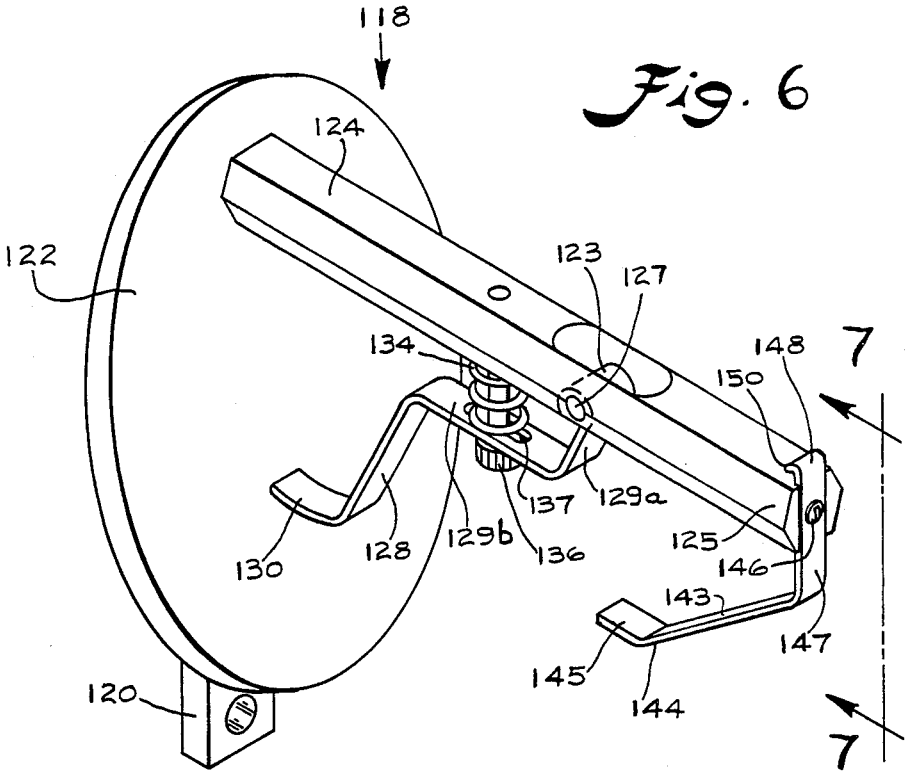
Fig. 6
Fig. 7
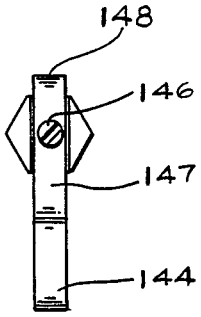

YARN PACKAGE HOLDER

RELATED APPLICATION

This application is a continuation-in-part of U.S. application Ser. No. 931,266 filed Nov. 17, 1986, for Yarn Package Holder.

BACKGROUND OF THE INVENTION

This invention pertains to a yarn package holder for textile machines and, more particularly, to an improved type weft yarn package holder for so-called outside filling supply or shuttle-less looms.

In looms of the outside filling supply type, that is, those looms in which the weft yarn is supplied from an outside source and is not carried to and fro through the warp shed by the shuttle or carrier itself, it is common practice to utilize a creel on one side of the loom to support and position weft packages from which the required weft yarn is withdrawn during operation of the loom.

Supports for yarn packages, where the yarn is wound onto a hollow tube, in which an adjustable or elastic holding device, provided at the middle of the tube holder, engages the inner wall of the tube are known. The existing supports, however, exhibit several disadvantages. One disadvantage is that in some types of supports the support is firmly attached to the tube. Another disadvantage is that many of the existing adjustable supports are provided with complicated adjusting mechanisms which make their manufacture very expensive; so much so that from an economic standpoint alone, it prevents their being used extensively in the textile industry. One such adjustable support device is found in U.S. Pat. No. 3,850,394, issued Nov. 26, 1974, to Raasch et al. This patent discloses a yarn package holder for receiving and securing a conical or cylindrical tube. This patent discloses a very complicated device for expanding a series of levers inside of the package to clamp or to hold the package on the support. As pointed out above, the mechanism shown in this patent is very complex and difficult for the operator to operate.

Another adjustable support for yarn packages is shown in U.S. Pat. No. 3,744,735 issued July 10, 1973, to Alfred Koenig. The yarn holder of this patent is embodied in an adjustable support comprising a spool holder provided with a shaft which at its free end has an external screw thread. A plurality of holding devices, slideably surround the shaft. Each of the holding devices comprises two longitudinally spaced annular portions which are connected with one another at their outer peripheries by a plurality of outwardly bowed spring layers. A nut engages the external screw thread of the shaft and abuts one of the annular portions of the holding device. As the nut is turned down on the shaft, the axial length of the holding device is decreased and the extent to which the spring layers are outwardly bowed is increased. The bobbin support may thus be adjusted to the shape of the tube so that it can support and hold the bobbin securely. Each holder comprises several of the spring-loaded holding devices. One disadvantage of this holding device is that it must be manually adjusted for each different diameter tube utilized thereon, and no means is provided for maintaining the yarn package in a fixed position relative to the creel on which it is supported. For example, the yarn package may become skewered on the support, thereby causing problems when the yarn is withdrawn at high linear speeds by the loom.

It is, therefore, a general object of the present invention to provide a yarn package support or holder which is readily adjustable to receive and secure packages wound on hollow tubes of various diameters without the necessity of adjusting the holding device.

A more specific object of the invention is to provide a yarn package support or holder which will receive and secure yarn packages wound on hollow cylindrical tubes of various diameters and to maintain the packages' orientation during the unwinding operation of the loom with respect to the creel.

SUMMARY OF THE INVENTION

A further object of the invention is the provision of a yarn package holder on which a yarn package may easily be placed or removed manually with the use of but a single hand.

The invention is embodied in a holder for receiving and frictionally securing packages of yarn wound onto hollow tubes of various inner diameters which includes a base support arm which is adapted to be attached to the creel of the loom. A contact arm for contacting the inside wall of the tube on which the yarn is wound is connected at one end to the base support arm and extends therefrom at an angle of about ninety degrees. A contoured support arm is pivotally connected to the contact arm at a point which is remote from where the end of the contact arm is connected to the base support arm. Spring means are interposed between the contact arm and the contoured support arm which urge the end of the contoured support arm away from the contact arm and against an inside wall of a hollow tube placed around the contact arm and the contoured support arm. The shape of the contoured arm is such as to permit it to frictionally engage and secure hollow tubes of various diameters. This support will support tubes of various inner diameters without requiring any adjustment in the holding mechanism itself.

Another embodiment has a shortened first contoured support arm, pivotally connected to the contact arm at a point intermediate the base and the end on the contact arm. A second resilient contoured support arm is rigidly fixed to the end of said contact arm and has one end which extends substantially transverse to the longitudinal axis of the contact arm for a slight distance past the edge of the contact arm, and another end which extends at an acute angle towards the base, but is resiliently adapted to contact the wall of the hollow tube at a point opposite where the contact arm contacts such tube.

BRIEF DESCRIPTION OF THE DRAWINGS

The novel features which are considered as characteristic of the invention are set forth in particular in the claims appended to this application. The invention itself, however, both as to its construction and to its method of operation, together with additional objects and advantages thereof, will be best understood from the following description of a specific embodiment when read in connection with the accompanying drawings.

FIG. 3 is a perspective view of a first embodiment of the yarn package holder of the invention, with the tube removed;

FIG. 4 is a side view of the holder illustrated in FIG. 3, showing a tube supported by the holding mechanism with parts of the tube broken away for clarity;

FIG. 5 is a view similar to that shown in FIG. 4, but wherein the holder has been modified to receive smaller cylindrical tubes;

FIG. 6 is a view similar to that shown in FIG. 3, showing a second embodiment of the invention in perspective, with the tube removed;

FIG. 7 is an end view of the holder illustrated in FIG. 6 taken along line 7—7;

DETAILED DESCRIPTION OF THE INVENTION

Figure 1:
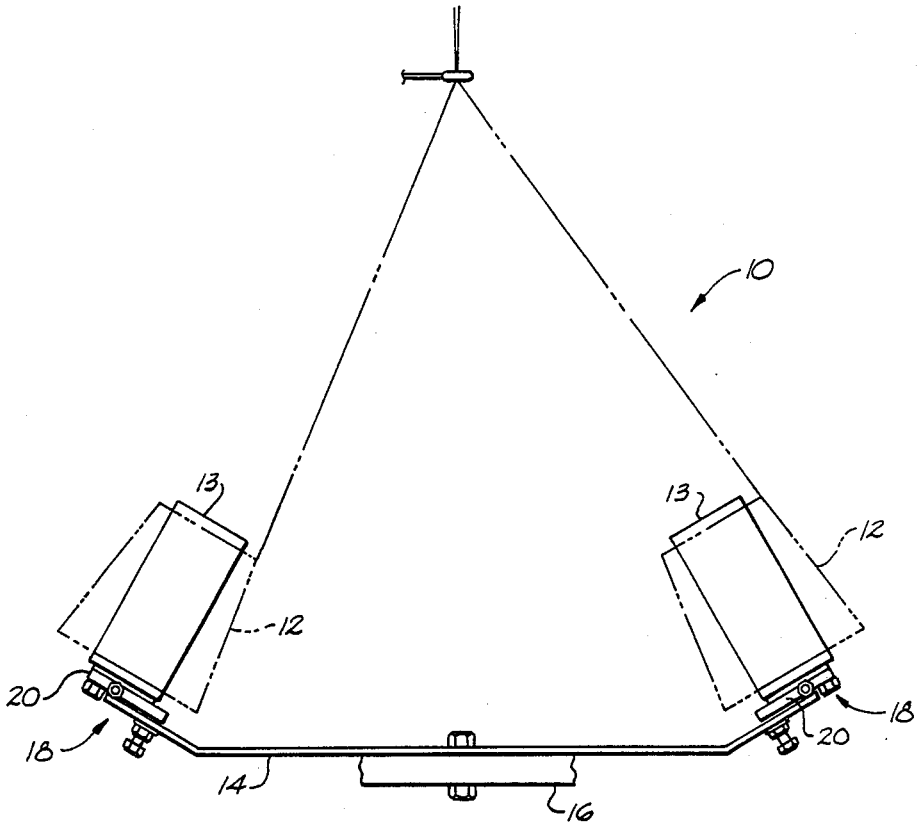
FIG. 1 is a diagramatic plan view of a yarn creel such as those used on outside filling supply looms.
Figure 2:
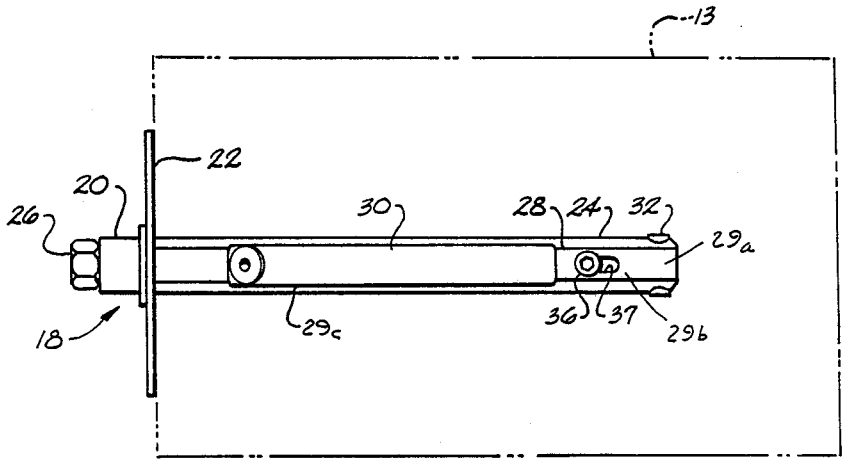
FIG. 2 is an enlarged detail plan view showing the yarn package support holder of the invention attached to the creel arm.

Referring now to FIGS. 1 and 2, there is shown a yarn creel 10, suitable for application to a textile machine such as an outside filling supply loom or a knitting machine, as desired. Creel 10 comprises a support arm 14 which is bolted to the frame 16 to retain it in place. Two yarn packages 12 are wound onto tubes 13 and supported on yarn package holders 18 which are connected to support arm 14 by suitable bolts. The term "tube" as used herein means conical and cylindrical tubes of various lengths and diameters.

Referring now to FIGS. 3, 4, and 5 wherein is shown one embodiment of the holder of the invention. Holder 18 comprises a base support 20 in the form of an arm, which, in use, is attached to creel support arm 14. Extending from the base support 20 at approximately a ninety degree angle is a tube contact arm 24. A reduced portion of contact arm 24 extends through a support plate 22 and base support 20 and is secured rigidly in place by a nut 26 which is threaded onto the reduced portion of contact arm 24. Thus, contact arm 24 extends from base plate 22 and base support 20 in a cantilevered fashion.

As can be seen from the drawings, the contact arm, as illustrated, is hexagonal, but it will be understood that the configuration of the tube contact arm may be selected as desired as long as a surface which comes into contact with the inner surface of tube 13 extends generally at right angles to the longitudinal axis of the base support 20.

On the free end of the tube contact arm 24, a contoured package support arm is pivotally connected. Contoured package support arm 28 has a stepped configuration which permits it to be readily depressed by the insertion of a tube 13 thereon. The contoured package support arm is provided with a sleeve 30 of frictional material such as rubber in its curved portion which is designed to come into holding contact with the inside wall of tube 13.

Interposed between the tube contact arm 24 and the contoured package support arm 28, is a spring 34 which is held into place by a fixed shank of a fastener in the form of a machine screw 36 which extends through slot 37 in arm 28. Spring 34 normally urges contoured package arm 28 away from the tube contact arm 24 and into frictional contact with the inside wall of tube 13.

The contoured support arm 28 includes a nose portion 29 having an inclined yarn package guiding surface 29*a* which guides the package up and over screw 36*a*, a biased bridge portion 29*b*, and an outwardly bowed package engaging portion 29*c*. More particularly, slot 37 has sufficient length to allow relative movement of contoured arm 28 and the fixed shank of fastener 36 facilitating pivoting of the contoured arm 37. Bridge portion 29*b* contains slot 37 and bridges yarn package guiding surface 29*a* and bowed portion 29*c*. Yarn package guiding surface 29*a* guides a yarn tube over the head of fastener 36 and onto bowed portion 29*c* in a manner that enables one handed operation from an opposing side of the holder.

Where relatively small diameter tubes are utilized, as seen in FIG. 5, the tube contact arm comes directly into contact with the inside wall of the tube. However, when very large tubes are used, a spacer bar 38 is placed along side the tube support arm 24 and interposed between the tube support arm and the inside wall of the tube. Spacer bar 38 is held in place against the tube contact arm by means of a machine screw 40 and a pin 42 which maintains the appropriate alignment of the spacer bar with the tube contact arm.

In operation, the first embodiment of the holder of the present invention will receive and secure yarn packages wound on various diameter tubes without any adjustment of the mechanism, as for example seen in FIG. 5. The surface of the tube contact arm 24 maintains the yarn package at a right angle to the base 22 so that the operator of the loom may adjust the orientation of the package on the loom and expect it to be maintained even under the conditions of vibration that exist on looms or weaving machines. The rigid connection of the tube contact arm to the base support arm assures this continued relationship between the yarn package and the base.

It has also been found that the same relationship can be maintained for much greater diameter tubes such as that shown in FIG. 4 by interposing a spacer bar 38 between the tube contact arm and the inside of the tube without sacrificing in any degree the rigidity of the yarn support and the continued proper orientation of the yarn package on the creel.

Referring now to FIGS. 6, 7, 8, and 9, wherein it is shown another embodiment of the holder of the invention. Holder 118 comprises a base support 120 in the form of an arm, which, in use, is attached to creel support arm 14. Extending from the base support 120 at approximately a ninety degree angle is a tube contact arm 124. A reduced portion of contact arm 124 extends through a support plate 122 and base support 120 and is secured rigidly in place by a nut 126 which is threaded onto the reduced portion of contact arm 124. Thus, contact arm 124 extends from base plate 122 and base support 120 in cantilevered fashion.

As can be seen from the drawings, in this embodiment the contact arm is also hexagonal, but it will be understood that the configuration of the tube contact arm may be selected as desired as long as a surface which comes into contact with the innersurface of tube 113 extends generally at right angles to the longitudinal axis of the base support 120.

Figure 9:
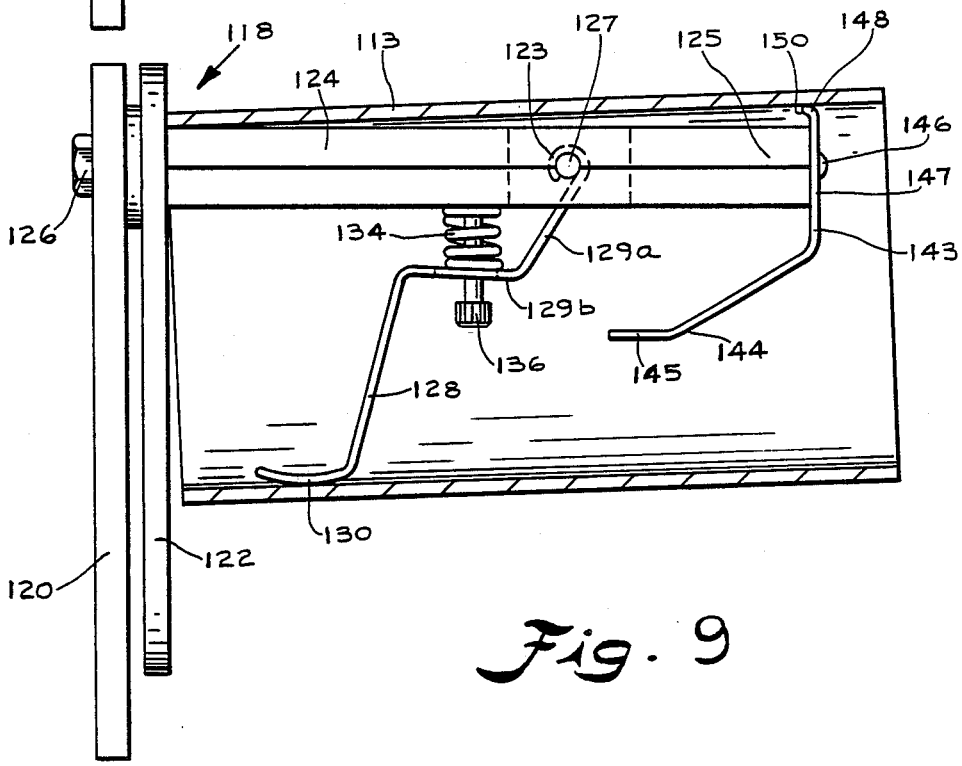
FIG. 9 is a view similar to that shown in FIG. 8, but showing the holder supporting a cylindrical tube.

Intermediate the free end 125 of tube contact arm 124 in a centrally disposed groove is pivoted a contoured package support arm 128. Arm 128 is pivoted about a pin or pivot 127 and has a portion 123 which curls about pivot 127. The contoured package support arm 128 has a stepped configuration which permits it to be readily depressed by the insertion of a tube 113, thereon, as seen in FIG. 9.

Interposed between the tube contact arm 124 and the contoured package support arm 128, is a spring 124 which is held in place by the fixed shank of a fastener in the form of a machine screw 136 which extends through slot 137 in arm 128. Spring 134 normally urges the contoured package arm 128 away from the tube contact arm 124 and into frictional contact with the inside wall of tube 113. Slot 137 has a length sufficient to allow relative movement of contoured arm 128 and the fixed shank of fastener 136, facilitating pivoting of the contoured arm 128. The contoured support arm 128 has an inclined yarn package guiding surface 129*a* which guides the inner surface of the tube up and over screw 136. Slot 137 is located in a bridge portion 129*b* which bridges angular surface 129*a* and 128. Surface 130 is curved to contact the inside surface of a cylindrical tube of intermediate diameter, as seen in FIG. 9.

In the second embodiment, as seen in FIGS. 6, 7, 8, and 9, contact arm 124 is provided with an extension or free end 125 which extends beyond pivot 127. Affixed to the end of extension 125 is a second resilient contoured arm 143 which is held to the end of extension 125 by means of a machine bolt or a machine screw 146. Contoured arm 143 has a portion 147 which extends transversely of the longitudinal axis of contact arm 124. On one side of contact arm 124, contour lever 143 terminates in a lip 148 which is curved towards base 122 as seen at 150. To facilitate the insertion of tubes onto the holder tip 150 extends a distance not in excess of three-sixteenths of an inch and need be only sufficient so as to engage the inside surface of tube 113.

On the side of the contact arm 124, and particularly extension 125, opposite tip 148, arm 143 extends at an acute angle towards base 122 forming a bridge surface 144. Contour lever 143 terminates in a tube contact portion 145. Contour arm 143 is formed of a resilient material such as spring steel and is adapted to be depressed when a cylindrical tube of small diameter or a small conical tube is inserted thereon, as seen in FIG. 8 of the drawings.

Figure 8:
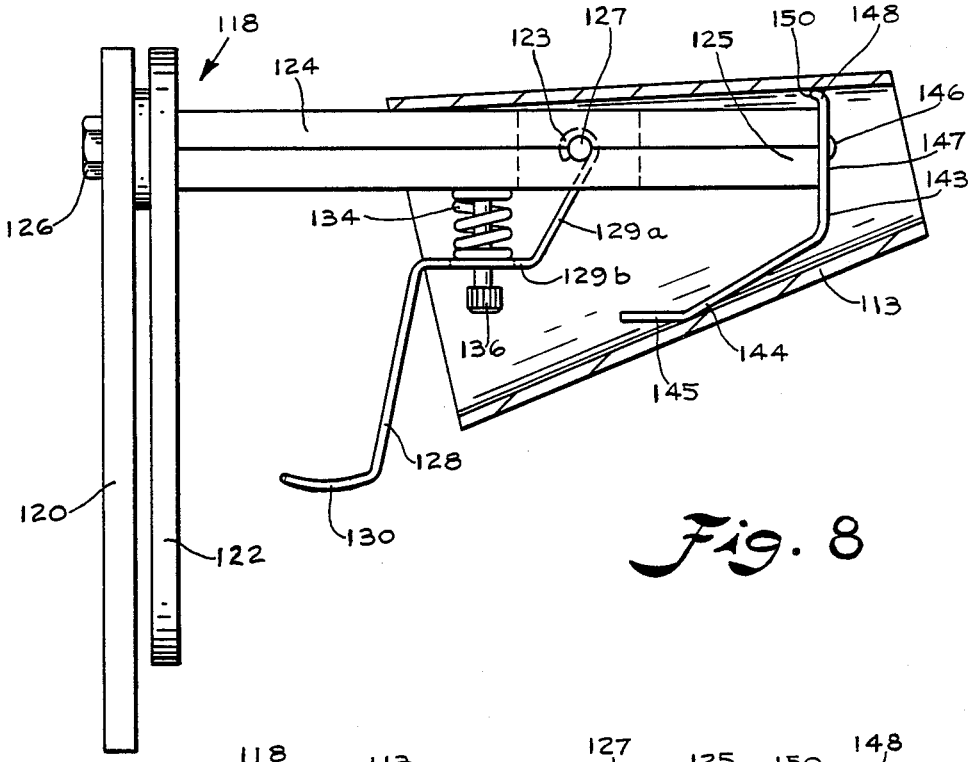
FIG. 8 is a side view of the holder illustrated in FIG. 6, showing a conical tube supported by the holding mechanism with parts of the tube broken away for clarity.

In operation, the holder of the second embodiment of the invention will receive and secure yarn packages wound on various kinds and sizes of tubes, which may be either cylindrical or conical without any adjustment of the mechanism as seen, for example, in FIGS. 8 and 9. The surface of the tube contact arm 124 maintains the yarn package at substantially a right angle to base 122 so that the operator of the loom may adjust the orientation of the package on the loom and expect it to be maintained even under conditions of vibration that exists on looms or weaving machines. The rigid connection of the tube contact arm to the base support arm assures this continued relationship between the yarn package and the base.

As seen in FIGS. 8 and 9, one wall of the tube is supported by lip 148 and contact arm 124. Lip 148 engages the wall of the tube and partially penetrates the wall to firmly lock the tube in place. The downward curve 150 of tip 148 serves to facilitate this locking relationship between tip 148 and the wall of the tube. Tip 148 serves to lock the tube in place on the holder whether the conical tube seen in FIG. 8 or the cylindrical tube seen in FIG. 9 is supported by the holder. As noted above, the length of tip 148 should not exceed three-sixteenths of an inch. A length greater than this will tend to make it difficult to remove the tube from the holder and will destroy the substantial right angle relationship between the tube and the base.

Although the present invention has been described in connection with two embodiments, it is to be understood that modifications and variations may be resorted to without departing from the spirit and scope of the invention as those skilled in the art will readily understand. Such modifications and variations are considered to be within the purview and scope of the invention and the appended claims.

What is claimed is:

1. A holder for receiving and frictionally securing packages of yarn, wound onto hollow tubes of various inner diameters and configurations, comprising:

(a) a base support, adapted to be attached to a creel for a textile machine;

(b) a contact arm for contacting an inside wall of a hollow yarn tube, one end of which is rigidly connected to said base support, said contact arm extending from said base support in a cantilevered manner and terminating in a free end; and (c) a contoured resilient support arm, one end of which is fixed to said free end of said contact arm, said one end extending generally transversely to the longitudinal axis of said contact arm and beyond the surface of said contact arm for a slight distance and terminating in a free edge for engaging an inside wall of the hollow tube immediately adjacent the free end of the contact arm and the other end of which extends in a cantilevered fashion towards said base at an acute angle to the longitudinal axis of said contact arm, and which terminates in a surface for contacting the inside wall of a hollow tube at a point which is opposed to the point where said contact arm contacts the inside wall of said hollow tube to assure contact between the inside wall of said tube with said contact arm.

2. A yarn package holder as set forth in claim 1, wherein said contoured resilient support arm extends towards said base at an angle not less than 45 degrees to the longitudinal axis of said contact arm when no tube is supported thereon.

3. A yarn package holder as set forth in claim 1, wherein said one end does not extend past the tube contact surface of the contact arm for a distance of more than three-sixteenths of an inch.

4. A yarn package holder as set forth in claim 1, wherein the tip of said one end is arcuate and is curved towards said base.

5. A yarn package holder as set forth in claim 2, wherein said one end does not extend past the tube contact surface of the contact arm for a distance of more than three-sixteenths of an inch.

6. A yarn package holder as set forth in claim 2, wherein the tip of said one end is arcuate and is curved towards said base.

7. A yarn package holder as set forth in claim 3, wherein the tip of said one end is arcuate and is curved towards said base.

8. A holder for receiving and frictionally securing packages of yarn, wound onto hollow tubes of various configurations and inner diameters, comprising:

(a) a base support, adapted to be attached to a creel for a textile machine;

(b) a contact arm for contacting an inside wall of a hollow yarn tube, one end of which is rigidly connected to said base support, said contact arm extending from said base support in a cantilevered manner and terminating in a free end portion;

(c) a first contoured support arm, having a pivot which connects said contoured support arm to said contact arm at a point intermediate said base support and said free end and a distal free end which extends in the direction of said base support, but terminating short thereof;

(d) resilient means interposed between said contact arm and said first contoured support arm at a distance from said pivot and between said pivot and said base support, said resilient means urging said distal free end away from said contact arm in a manner that said first contoured support arm and said contact arm are urged against opposite inside walls of a hollow tube placed about said contact arm and said contoured support arm to secure said hollow tube to said base support; and (e) a resilient second contoured support arm, one end of which is affixed to said free end of said contact arm, having a first end portion which extends transversely to the longitudinal axis of said contact arm for a slight distance past the surface of said contact arm and a second end which extends towards said base support at an acute angle to the longitudinal axis of said contact arm and which terminates in a surface for contacting the inside wall of a hollow tube at a point which is opposed to a point where said contact arm contacts the inside wall of said hollow tube to assure contact between the inside wall of said tube with said contact arm.

9. A yarn package holder as set forth in claim 8, wherein the portion of the contoured support arm which contacts the inside wall of the tubes is curved outwardly so as to present a firm contact against the inner wall of the hollow tube for tubes of various inner diameters.

10. A yarn package holder as set forth in claim 8, wherein said resilient means comprises a compression spring disposed about a fastener shank which passes freely through an elongated opening in the contoured support arm and is rigidly attached to said contact arm, and said elongated opening having a sufficient length to permit movement of said contoured support arm relative to said fastener shank in an axial direction along a longitudinal axis of said contact arm.

11. A yarn package holder as set forth in claim 8, wherein said contoured resilient support arm extends towards said base at an angle not less than 45 degrees to the longitudinal axis of said contact arm when no tube is supported thereon.

12. A yarn package holder as set forth in claim 8, wherein said one end does not extend past the surface of the contact arm for a distance of more than three-sixteenths of an inch.

13. A yarn package holder as set forth in claim 8, wherein the tip of said one end is arcuate and is curved towards said base.

14. A yarn package holder as set forth in claim 12, wherein said one end does not extend past the surface of the contact arm for a distance of more than three-sixteenths of an inch.

15. A yarn package holder as set forth in claim 13, wherein the tip of said one end is arcuate and is curved towards said base.

16. A textile yarn package holder for receiving and frictionally securing packages of yarn wound onto the hollow tube, comprising:

(a) a base support adapted to be attached to the support of an associated textile machine;

(b) a contact arm for contacting an inside wall of a yarn tube, one end of which is rigidly secured to said base support and the other end of which extends from said base support in a cantilevered manner terminating in a free end;

(c) a first contoured support arm, one end of which is connected to said contact arm by a pivot at a point intermediate said free end of said contact arm and said base support;

(d) said contoured support arm including a portion for gripping an inside wall of said yarn package tube;

(e) resilient means interposed between said contact arm and said contoured support arm at a point intermediate said pivot and said base support, said resilient means urging said contact arm and said first contoured arm against opposite inside walls of a hollow tube placed about said contact arm and said first contoured support arm to secure said hollow tube to said base support; and (f) a resilient second contoured support arm one end of which is fixed to the free end of said contact arm and having a first end which extends generally transverse to the longitudinal axis of said contact arm for a slight distance and a second end which extends towards said base at an acute angle to the longitudinal axis of said contact arm having a surface for contacting the inside wall of a hollow tube to assure contact between said walls of said tube with said contact arm.

* * * * *